United States Patent [19]

Ericsson

[11] Patent Number: 4,708,488

[45] Date of Patent: Nov. 24, 1987

[54] MIXER FOR WATER AND WASTE MATERIAL

[75] Inventor: Tor S. Ericsson, Danderyd, Sweden

[73] Assignee: Cementa AB, Danderyd, Sweden

[21] Appl. No.: 793,297

[22] Filed: Oct. 31, 1985

[30] Foreign Application Priority Data

Oct. 31, 1985 [SE] Sweden ..... 8405458

[51] Int. Cl.[4] ..... B28C 5/00

[52] U.S. Cl. ..... 366/2; 366/137; 366/139

[58] Field of Search ..... 366/101, 106, 107, 136, 366/137, 139, 332, 262, 131, 132, 134, 154, 159, 173, 1, 2, 3, 5, 40, 51, 348, 349, 163, 167, 173, 176, 190

[56] References Cited

U.S. PATENT DOCUMENTS

| | | | |
|---|---|---|---|
| 989,070 | 4/1911 | Simmons | 366/139 |
| 1,660,280 | 2/1928 | Thomson | 366/2 |
| 1,687,067 | 10/1928 | Hinton | 366/3 |
| 1,790,902 | 2/1931 | Cowles | 366/137 |
| 2,338,174 | 1/1944 | Garrison | 366/101 |
| 2,516,436 | 7/1950 | Walker | 366/139 |
| 3,003,752 | 10/1961 | Frost | 366/106 |
| 3,201,093 | 8/1965 | Smith | 366/136 |
| 3,236,504 | 2/1966 | Galer | 366/3 |
| 3,582,046 | 6/1971 | Mueller | 366/106 |
| 3,608,866 | 9/1971 | Karpacheva | 366/106 |
| 3,653,639 | 4/1972 | Mueller | 366/106 |
| 3,902,558 | 9/1975 | Watson | 366/101 |
| 4,474,254 | 10/1984 | Etter | 366/136 |

FOREIGN PATENT DOCUMENTS 1280576 11/1961 France .

*Primary Examiner*—Robert W. Jenkins
*Attorney, Agent, or Firm*—Young & Thompson

[57] ABSTRACT

A transportable mixer consisting of a double bottomed load body 3 for a change-load vehicle has the space between the bottoms divided into longitudinal compartments and the upper bottom consisting of a screen plate. To each compartment 11, 12, 13 via a switching mechanism 20, there is connected a hose 14, 15, 16, 21, 22 to a pump 23. After water is added, the compartments are subjected with the aid of the switching mechanism to alternating pressure and suction, whereby the material loaded into the body is slurried from below and can be pumped out 24, 25 to the desired location. The screen plate retains coarser contaminants, e.g., stones or sticks. The load body can float and be towed on lakes, but can also be made in the form of a boat with a pump, switching mechanism and its own motor for driving and mixing. The body can be used to make use of old deposits of lime sludge for liming of lakes and soil, for industrial use of fly ash and similar waste materials etc.

12 Claims, 9 Drawing Figures

MIXER FOR WATER AND WASTE MATERIAL

Disposal of various types of waste is a rapidly growing problem which is becoming increasingly difficult as new types of waste arise and industry produces increasing amounts of waste. A relatively new problem is so called fly ash from coal power plants with waste produced in amounts on the order of 100,000 tons per year. Other waste products produced in the same order of magnitude are gypsum and lime sludge. Gypsum is stored at present and only small amounts can be used, for example, plaster board or cement etc. Lime sludge is presently burned for regeneration, but great amounts still remain in older deposits and can now be used for example for liming of acidic lakes, provided the handling problem can be solved. Fly ash can also potentially be widely used if the handling cost can be kept reasonable. It is quite obvious that if waste products with a large negative value can be put to good use and thus receive a positive value, this can be quite valuable economically, in addition to solving many ecological problems. Only a couple of the problematic types of waste are mentioned here, a list of waste types with conceivable practical use would be quite long. The present invention is however directed primarily to solving the problems with fly ash and lime sludge, where uses have already been worked out even though the invention can be used with advantage for gypsum when a practical large scale use is developed. The mixer according to the invention can also be used for many other substances, both waste materials and other materials, the handling of which is both costly and laborious.

The handling of powdered substances, both in dry form as well as moist or semi-liquid form, can be quite complicated requiring much work and can also involve problems in preventing spillage and pollution of the environment. By transforming the powder or sludge or semi-solid mass into a pumpable slurry, the handling problem is solved quite elegantly. The waste can be emptied from one transport vehicle to another, from a truck to a boat for example and be pumped out for use in inaccessable locations, where mechanical unloading equipment can only be used with difficulty or at great expense.

The mixer according to the invention will be described in more detail with reference to lime sludge and problems connected therewith. Lime sludge is a waste product from sulphate factories and consists primarily of fine grained calcium carbonate, gympsum and some tenths of a percent sodium salts. Very large deposits remain from those years before recycling was introduced at the sulphate factories. The formation, characteristics and problems involved with lime sludge are described in detail in quite extensive literature, and will therefore not be discussed in more detail here. Some other problems are also involved in the handling of fine grained limestone waste.

With regard to the problem of acidification by airborne sulphur compounds, lime sludge has a potential value as a neutralizing agent providing it can be transported, handled and dispensed at reasonable cost. Large amounts of lime sludge are thus stored at many different locations. The lime sludge has been pumped out into large pools dug into the earth and remains there as an apparently hard but very tixotropi mass with a dryness of about 30–50%. During handling and transport, the sludge becomes increasingly soft and stickly due to vibrations, so that it can be difficult to tip the sludge out of the platform body. Another problem is that the sludge may be contaminated with stones which must be removed prior to spreading it with mechanical devices. The system of the invention for using lime sludge involves making the sludge into a slurry before use to make pumping possible. Another alternative is drying which is, however, more expensive. The system makes it possible to make use even of mechanically contaminated lime sludge to achieve effective and simple extraction of the deposits and complete use of the sludge. The preparation of the slurry can take place either at the extraction site or at the site for final use.

In liming of lakes e.g. it is also advantageous that the lime sludge be thoroughly slurried in a homogenous slurry before being spread out in the lake water.

The system according to the invention is based on the transportation of the lime sludge in non-solid cargo carriers, e.g. charge load bodies, which with simple adaptions, can be used to prepare the slurry.

The invention will be described in more detail below with reference to the accompanying drawings, of which:

Figure 3:
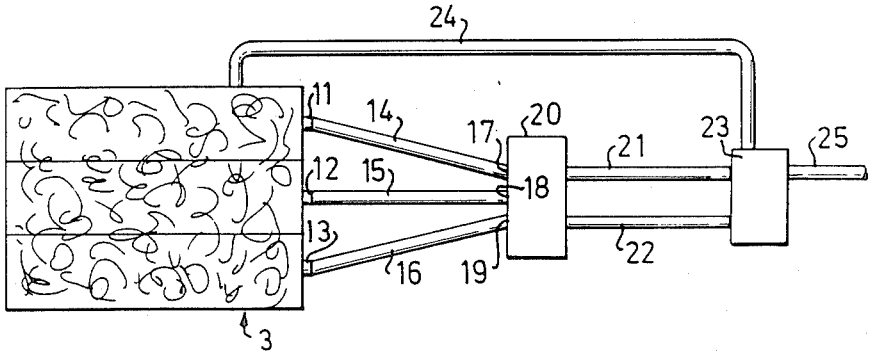
Figure 4:
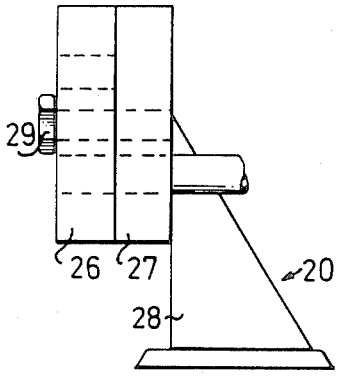
Figure 5:
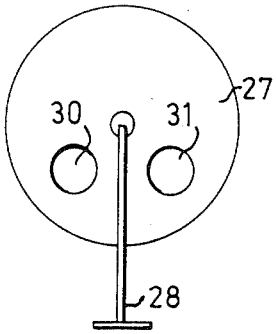
Figure 6:
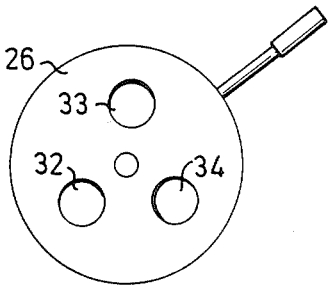
Figure 7:
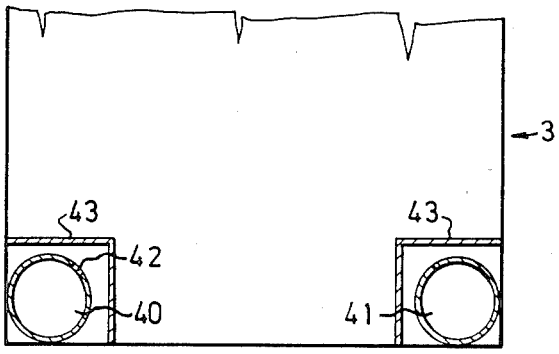
Figure 8:
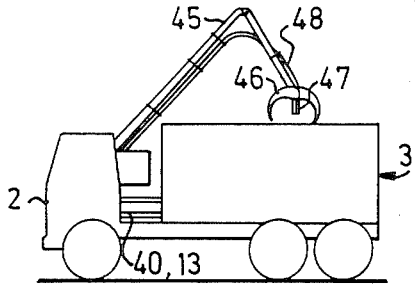
Figure 9:
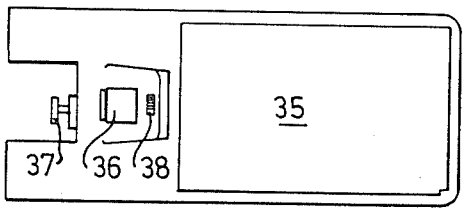

FIG. 3 shows the layout of a load body for slurring of the lime sludge as seen from above, FIG. 4 shows the switcing mechanism, FIG. 5 shows the sixth plate of the switching mechanism, FIG. 6 shows the movable plate of the switching mechanism, FIG. 7 shows an alternative device according to the invention in cross-section, FIG. 8 shows the device of FIG. 7 in side view, and FIG. 9 shows a modified load body or boat, according to the invention, for liming acid lakes.

Even though the invention is described below with reference to lime sludge, it can also be used with advantage as a mixing device for other liquid, semi-liquid, powdered or solid materials.

Figure 1:
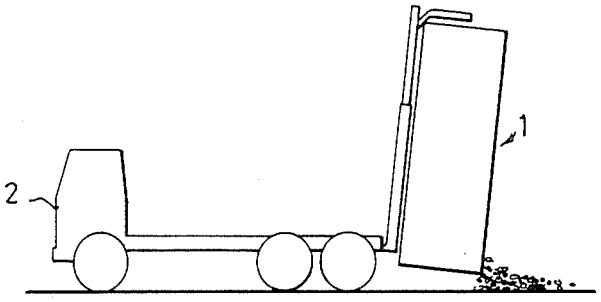
FIG. 1 is a charge load device.

FIG. 1 illustrates conventional dumping with a detachable load body 1 carried by a detachable tractor 2 of the type used for chip transports. Even the dumping angle shown, 90°, will not suffice for lime sludge, which sticks to the load body forming an unmanagable mass.

Figure 2:
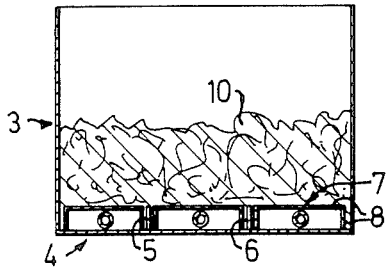
FIG. 2 is a load body according to the invention in cross section.

One embodiment of the load body according to the invention for slurrying of lime sludge in the load body and for pumping out of this slurry, is shown in cross-section in FIG. 2. The load body is made as a rectangular, open box 3 of steel plate. The box floor board is reinforced with longitudinal beams 5, 6 extending across the entire length of the bottom. Screen plates 7 bent into a U-shape with their legs 8 approximately as high as the beams 5, 6 and with their center portion 9 corresponding to the distance between the beams, are laid across the entire bottom surface between the beams. The screen plates are easily replaceable in order to provide a variety of mesh sizes. The lime sludge 10 is shown loaded on top of the screen plates.

There are three holes 11, 12, 13 in one end, which are provided with taps and connections for quick coupling of hoses. Each hole is arranged approximately directly in front of the U-opening of each screen plate.

The body or mixer has the dimension $6 \times 2.5 \times 2$ m and a volume of 30 $m^3$ to fit existing detachable tractors. The sides have been reinforced by corrugation and the bottom with supporting beams. The beams 5,6 have a height of 5–25 cm and the edges of the screen plates are the same with a width of about 80 cm. The holes in the screen plates are about 20 mm in diameter and cover approximately half of the area of the screen plates. The holes 11, 12, 13 in the end of the body have connections for 3′ hoses. FIG. 3 shows the arrangement of a body for slurring up the lime sludge. To each hole in the mixer there is coupled with a tap and a quick-coupling, a hose 14, 15, 16, which with a corresponding connection 17, 18, 19 is coupled to a reversing or switching mechanism 20. The reversing mechanism 20 is coupled via two hoses 21, 22 to the pressure and suction side of a pump 23. Two additional hoses are also connected to the pressure or suction sides of the pump, one 24 to the upper edge of the body for pumping in water or for pumping out slurry to the desired location. In order to slurry the lime sludge the compartments formed by the screen plates are alternately subjected to pressure and suction with the aid of the switching mechanism 20. The switching mechanism 20 consists of two circular discs, 26, 27 held together by a central bolt 29. One disc 27 is sercurely mounted on a bracket 28 and the central bolt 29 is securely threaded therein. The other 26 is rotatable about the central bolt and is provided with a handle for quickly switching between the various positions.

The fixed disc 27 has two through holes, one 30, which, on the rear of the disc is connected to the hose 21 and the pressure side of the pump 23. The other 31, is connected to the hose 22 and the suction side of the pump. The movable disc 26 has three holes 32, 33, 34 which are connected in the same manner via the hoses 14, 15, 16 to the respective holes in the body 11, 12, 13. The discs seal against each other and the switching mechanism can connect the holes 11, 12, 13 as desired to the pressure or suction side of the pump or seal them off.

The procedure during a work cycle is that the lime sludge is loaded into the body at the storage location and is transported to the unloading location where the body, either resting on the tractor or unloaded is connected to the switching mechanism 20 with the hoses 14, 15, 16. Water is pumped in from the hose 25 by the pump 23 and proceeds either through the hose 24 or via the switching mechanism 20 through one of the hoses 14, 15, 16. When a sufficient amount of water has been pumped in the hoses 24 and 25 are closed with valves and water or slurry is pumped from the compartment under the screen plate via for example hole 11, hose 14 and switching mechanism holes 32 and 31, and hose 22 to the pump. The water or slurry is then pressed by the pump through the hose 21, the switching mechanism holes 30 and for example 33, the hose 15 and the hole 12 in the body to the space under the corresponding screen plate. The third compartment with the hole 13 and the hose 16 is closed since the hole 34 is closed by the fixed disc 27. By virtue of the flexibility of the hoses, the movable disc 26 can be shifted easily and quickly between the different positions with the aid of the handle, so that the compartments under the screen plates will be connected in sequence to the pressure and suction sides of the pump. Rapid shifting between pressure and suction will quite effectively slurry the lime sludge from below and this sludge can easily be pumped out to be spread on the ground or in the water. The screen plates prevent large stones and other solid contaminates from being drawn into the pump or clogging the hoses, while gravel and other smaller contaminates will pass without hindrance. Heavier material deposited on top of the screen plates can be easily emptied out of the body after the slurry has been pumped out (see FIG. 1). Due to the fact that the pumping out can be done correctly at the desired location, in a field for example, the handling costs are brought down to a minimum and heavy work steps are eliminated.

In certain cases, the properties of the lime sludge will make it very difficult to slurry. Other materials can also have other properties making it unsuitable for the device described above. In these cases, there is a modified embodiment, as shown in FIG. 7 and 8. Instead of the screen bottom and the three pipes lying thereunder, there have been placed along the sides of the body near the bottom two pipes 40, 41 with through holes and connections in the front end wall of the body. The pipes can be made with various cross-sectional shapes, e.g., round, triangular or square. Approximate dimensions which have proved suitable are a pipe diameter/width of about 10 cm. Along the entire length of the pipes there is an opening 42 which is covered by a screen plate 43 with 10–20 mm hole diameters and approximately 50% hole surface. These dimensions can however be varied considerably depending on what materials are to be used, but all changes in dimensions can be made quite simply and quite inexpensively. After the through holes have been made in the front end wall, the loose pipes can be laid in the body, which can also be used for other transport purposes.

On a special vehicle 2, e.g., a dumper or off-road vehicle, there is mounted a change-load device. In front of this on the chassis there are mounted an hydraulically driven pump 23, a switching mechanism 20 and fixed tubes with connections 11, 13, which are similarly shown in FIG. 3.

Pulling up the detachable body automatically connects the pipes 40, 41 made as male components, with connections 11 and 13, made as female components. (Only connection 13 and pipe 40 are shown in FIG. 8.)

The special vehicle is also equipped with a movable articulated crane arm 45 on which a bucket 46, blade or other means can be mounted for mechanically working the material. At the other end of the arm 45 there is also arranged a heavy nozzle for liquid, which is connected via a hose 48 to the switching mechanism 20 and the pump 23. The special vehicle picks up the detachable body at the location where the highway vehicle has left it. It is loaded with 9–10 tons of lime sludge. When the body is pulled onto the special vehicle, the body is connected to the pump system as described above. With the aid of the pump 23, a suitable amount of lake water is sucked into the system and is pumped into the pipes 40, 41. The amount of water depends on the desired concentration of solids in the finished slurry.

A liquid slurry is formed by injection through the screen plate 43, and after mixing has been concluded by reversing the switching mechanism 20, the slurry is drawn into the pipes 40, 41 to the pump to be sprayed out through the nozzle 47 at the same time as the mixture in the body is stirred by the bucket or other stirring means on the crane arm. By repeated reversal of the flow direction combined with the mechanical stirring, the mixture is slurried quite effectively and even difficult lime sludge is easily converted to a pumpable form in this manner.

The powerful slurry flow from the nozzle 47 is directed so that it both cleans off the stir and contributes to the slurrying of the lime sludge. A slurry can also be prepared by first supplying the body with the desired amount of water and then loading the lime sludge into the body with the aid of the crane arm 45, which in this case must be provided with a bucket. By using the nozzle 47 to rinse out each scoop of lime sludge in the body, the slurrying of the sludge is facilitated.

The nozzle 47 can also be used to empty the body into other transport means or for the final spreading of the slurry. In order to lime fields, the slurry can be spread directly by the nozzle 47, but in order to lime acid lakes, it is essential to spread the pH raising substance as effectively as possible there. In this case the slurry can be pumped out from the body to special spreading equipment such as a boat or large pump system with hoses laid out in the lake. Another alternative is to launch the bodies which will function as barges which can be towed out with a small boat to the distribution target. The slurried preparation and the spreading are then done with the accompanying pump as described above. The equipment also includes a special body carrying boat which can be handled in and out of the water and can be transported with the change-load system. Such a boat is shown in FIG. 9. The width and length of the boat are the same as for one of the usual bodies, but the cargo compartment 35 is shortened so that the motor 36 with a raisable drive 37 and a pump 38 for mixing and distribution could be installed. A pumping capacity of 2000–3000 liters per minute has proved to be suitable. This pump capacity makes it possible to drive the boat by the reactive forces obtained by pumping out the slurry or water.

As has the handling of lime sludge, the handling of fly ash has also been expensive and difficult. Great amounts of fly ash are used as fill in the form of mud, for refilling pipe ditches, or for covering dumps and other deposits. The load body according to the invention also provides an effective mixing station which can be moved simply between various locations.

When using the equipment as a mixing station where dry powder is inserted and mixed into a slurry, the mixing is started by pumping around the liquid medium, whereafter the dry material is added to the system by direct feed into the pump flow. This can be effected automatically or via a screw.

I claim:

1. Method of slurrying powdered material with varying water contents, characterized in that the material is provided with water and is alternatingly subjected to pressure and suction from below through a screen arrangement which prevents coarse aggregate from passing through.

2. Method according to claim 1, characterized in that the pressure and the suction are achieved with a pump, through connection to the pressure and suction sides of the pump, thus providing a circulation at the same time as the slurrying.

3. Method according to claim 1, characterized in that the material is placed on a screen bottom, such that the area under the screen is divided into compartments, that the water is added from below by means of a pump, and that simultaneously and alternatingly, a third of the compartments are pressurized, a third are subject to suction and a third are left unaffected.

4. Method according to claim 1 or 2, characterized in that the material is introduced into the container and that water is added through longitudinal pipes at the bottom of the container sides, through openings in the pipes, covered by a screen plate, whereupon the slurry is sucked out through the pipes and is added from above possibly during simultaneous mechanical working, whereupon the force of the slurry spray is used to finely divide the load.

5. Mixer, in the form of a change-load body or similar container for collecting and mixing and distribution of fine grained material on fields, in lakes and the like, characterized in that it consists of a load body (3) for a change-load vehicle (2) for receiving solid material for slurrying, a pump (23) for pumping in and out liquid material, a switching mechanism (20) for reversing the direction of flow to and from the pump, means (32, 33, 34, 40, 41, 47) for adding and removing liquid material from the container, means (7, 42, 43) for preventing coarse aggregates of unslurried material and coarse contaminates from entering the pump.

6. Mixer according to claim 5, characterized in that the body (3) has a double bottom (4, 7) for material (10), the upper bottom (7) consisting of screen plates and the intermediate space between the bottoms being divided into longitudinal compartments with intermediate walls (5, 6) and that in the end wall of each compartment there is a hole (11, 12, 13) for connecting a pump (23) provided with a switching mechanism (20) alternatingly connected each compartment to the pressure or suction side of the pump to slurry the material from below.

7. Mixer according to claim 5, characterized in that the switching mechanism consists of a fixed disc (27) provided with two holes (30, 31) connected to the pump connections (21, 22) and a rotatable disc (26) with three holes (32, 33, 34), each coupled to one of the holes (11, 12, 13) in the end of the body, and that the movable portion (26) can be manoeuvred, and that the holes are arranged such that two of the holes (32, 33, 34) are in communication at the same time with the holes (30, 31) in the fixed portion, while the third hole (32, 33, 34) is closed off.

8. Mixer according to claim 5, characterized by two longitudinal pipes (40, 41) arranged at the bottom near the sides of the body, each with a longitudinal opening (42) covered by a screen plate (43) for the supplying and drawing out of liquid material, said screen plate acting as a separator for agglomerations and coarse material, holes in the body end plate for pipes and connection to the switching mechanism (20), an articulated arm (45) with (46) means (46) for mechanical stirring of the material during mixing and with a nozzle (47) and a conduit to the switching mechanism (20) or the pump (23) for spreading out the slurry during mixing or for spreading out or for serving as a water intake when loading.

9. Mixer according to claim 8, wherein said means for mechanical stirring is a bucket (46).

10. Mixer according to claim 8, wherein said means for mechanical stirring is a blade.

11. Mixer according to claim 5 or 8, characterized in that the pump (23), the switching mechanism (20) and the stirring means are permanently mounted on a special chassis (2), and that the body is connected to the switching mechanism (20) with male/female couplngs on the switching mechanism and the ends of the pipes (40, 41).

12. Mixer according to claim 5, further comprising devices (45, 46) for stirring.

* * * * *